US008899371B2

(12) United States Patent
Uno et al.

(10) Patent No.: US 8,899,371 B2
(45) Date of Patent: Dec. 2, 2014

(54) BULLDOZER

(75) Inventors: Akira Uno, Komatsu (JP); Ikuo Kita, Komatsu (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/883,199

(22) PCT Filed: Sep. 4, 2012

(86) PCT No.: PCT/JP2012/072465
§ 371 (c)(1),
(2), (4) Date: May 2, 2013

(87) PCT Pub. No.: WO2014/024324
PCT Pub. Date: Feb. 13, 2014

(65) Prior Publication Data

US 2014/0041956 A1 Feb. 13, 2014

(30) Foreign Application Priority Data

Aug. 10, 2012 (JP) ..... 2012-177672

(51) Int. Cl.

| | |
|---|---|
| ***B60K 17/356*** | (2006.01) |
| ***E02F 3/84*** | (2006.01) |
| ***E02F 3/76*** | (2006.01) |
| ***E02F 9/08*** | (2006.01) |
| ***E02F 9/22*** | (2006.01) |

(52) U.S. Cl.
CPC ..... *E02F 3/84* (2013.01); *E02F 3/7609* (2013.01); *E02F 9/0825* (2013.01); *E02F 9/0891* (2013.01); *E02F 9/2275* (2013.01)
USPC ..... 180/305; 180/307

(58) Field of Classification Search
CPC ..... B60K 17/14
USPC ..... 180/305, 307
See application file for complete search history.

(56) References Cited

U.S. PATENT DOCUMENTS 3,529,687 A * 9/1970 Pensa ..... 180/6.48
3,656,642 A * 4/1972 Kostas et al. ..... 414/697

(Continued)

FOREIGN PATENT DOCUMENTS

| | | |
|---|---|---|
| JP | 2005-113674 A | 4/2005 |
| JP | 2006-219871 A | 8/2006 |
| JP | 2009-507144 A | 2/2009 |

OTHER PUBLICATIONS

The Office Action for the corresponding Chinese application No. 201280004306.3, issued on Aug. 5, 2014.

*Primary Examiner* — Jeffrey J Restifo
(74) *Attorney, Agent, or Firm* — Global IP Counselors, LLP

(57) ABSTRACT

A vehicle body frame of a bulldozer has a left side frame, a right side frame, a base plate, and a cross member. The left and right side frames each extend in the front and back direction. The base plate spans across between the left and right side frames. The cross member is positioned between a hydraulic pump and left and right hydraulic motors. The cross member protrudes upward from the base plate. The cross member spans across between the left and right side frames. The cross member has a left conduit hole and a right conduit hole which are spaced apart in a left and right direction of the bulldozer. The first and second left hydraulic fluid tubes pass through the left conduit hole. The first and second right hydraulic fluid tubes pass through the right conduit hole.

12 Claims, 7 Drawing Sheets

(56) References Cited

U.S. PATENT DOCUMENTS

| | | | | |
|---|---|---|---|---|
| 3,789,942 | A * | 2/1974 | Kowalik | 180/9.44 |
| 3,797,598 | A * | 3/1974 | Wanner | 180/6.48 |
| 4,151,920 | A * | 5/1979 | Shoup | 414/697 |
| 4,220,215 | A * | 9/1980 | Stark | 180/6.7 |
| 5,894,908 | A * | 4/1999 | Eftefield | 280/781 |
| 6,076,619 | A * | 6/2000 | Hammer | 180/6.48 |
| 6,719,075 | B2 * | 4/2004 | Kamikawa | 180/9.1 |
| 6,902,027 | B2 * | 6/2005 | Soga et al. | 180/308 |
| 7,610,985 | B2 * | 11/2009 | Ohashi | 180/305 |
| 7,610,986 | B2 * | 11/2009 | Ohashi | 180/305 |
| 7,798,738 | B2 * | 9/2010 | Kawamoto et al. | 403/38 |
| 7,815,000 | B2 * | 10/2010 | Kisse et al. | 180/9.1 |
| 8,281,892 | B2 * | 10/2012 | Sugimoto et al. | 180/307 |
| 2002/0023786 | A1 * | 2/2002 | Kamikawa | 180/6.7 |
| 2002/0113433 | A1 | 8/2002 | Soga et al. | |
| 2014/0041956 | A1 * | 2/2014 | Uno et al. | 180/305 |

* cited by examiner

BULLDOZER

CROSS-REFERENCE TO RELATED APPLICATIONS

This application claims priority to Japanese Patent Application No. 2012-177672 filed on Aug. 10, 2012, the disclosure of which is hereby incorporated herein by reference in its entirety.

BACKGROUND

1. Technical Field

The present invention relates to a bulldozer.

2. Background Information

There are bulldozers which have an HST (Hydro Static Transmission) system. The HST system has a hydraulic pump and a hydraulic motor. The hydraulic motor for traveling is driven in the HST system using hydraulic fluid which is discharged from the hydraulic pump. The bulldozer travels due to this. Accordingly, the hydraulic pump and the hydraulic motor are connected by a hydraulic fluid tube in the HST system. The hydraulic fluid flows between the hydraulic pump and the hydraulic motor via the hydraulic fluid tube.

On the other hand, the bulldozer has a vehicle body frame as shown in Japanese Unexamined Patent Application Publication No. 2009-507144. The vehicle body frame has a right side frame, a left side frame, a base plate, and a cross member. The base plate is disposed to span across between the left and right side frames. The cross member is disposed so as to protrude upward from the base plate and is disposed to span across between the left and right side frames.

SUMMARY

The hydraulic fluid tube connects the hydraulic pump and the hydraulic motor. As a result, the hydraulic fluid tube is disposed so as to intersect with the cross member in a plan view in a case where the cross member is positioned between the hydraulic pump and the hydraulic motor. In this case, since the cross member is disposed so as to protrude from the base plate, it is necessary that the hydraulic fluid tube is disposed so as to bridge over the cross member. Accordingly, the hydraulic fluid tube has a shape with large curvature. The shape of the hydraulic fluid tube with the large curvature has an effect on the transmission efficiency of the driving force using the hydraulic fluid. As a result, there is a possibility that the fuel efficiency of the bulldozer is reduced.

The object of the present invention is to provide a bulldozer where it is possible to improve fuel efficiency.

A bulldozer according to a first aspect of the present invention is provided with a vehicle frame body, an engine, a hydraulic pump, a left hydraulic motor, a right hydraulic motor, a first left hydraulic fluid tube, a second left hydraulic fluid tube, a first right hydraulic fluid tube, and a second right hydraulic fluid tube. The engine is supported by the vehicle body frame. The hydraulic pump is driven by the engine. The left hydraulic motor and the right hydraulic motor are motors for traveling. The left and right hydraulic motors are disposed behind the hydraulic pump and are driven using the hydraulic fluid which is discharged from the hydraulic pump. The first and second left hydraulic fluid tubes connect the hydraulic pump and the left hydraulic motor. The first and second right hydraulic fluid tubes connect the hydraulic pump and the right hydraulic motor. The vehicle body frame has a left side frame, a right side frame, a base plate, and a cross member. The left side frame and the right side frame each extend in the front and back direction. The base plate is disposed to span across between the left and right side frames. The cross member is positioned between the hydraulic pump and the left and right hydraulic motors in the front and back direction. The cross member is disposed so as to protrude upward from the base plate. The cross member is disposed to span across between the left and right side frames. The cross member has a left conduit hole and a right conduit hole which are disposed to be separated to the left and right. The first and second left hydraulic fluid tubes are disposed to pass through the left conduit hole. The first and second right hydraulic fluid tubes are disposed to pass through the right conduit hole.

A bulldozer according to a second aspect of the present invention is the bulldozer according to the first aspect where the left and right hydraulic motors are disposed in positions which are lower than the hydraulic pump.

A bulldozer according to a third aspect of the present invention is the bulldozer according to the second aspect where base portions of the left and right conduit holes are positioned at the same height as the base plate.

A bulldozer according to a fourth aspect of the present invention is the bulldozer according to any of the first to the third aspects where the hydraulic pump has a first left pump port, a second left pump port, a first right pump port, and a second right pump port. The first left pump port and the second left pump port are provided on a left side surface of the hydraulic pump. The first right pump port and the second right pump port are provided on a right side surface of the hydraulic pump. The first left hydraulic fluid tube is connected to the first left pump port. The second left hydraulic fluid tube is connected to the second left pump port. The first right hydraulic fluid tube is connected to the first right pump port. The second right hydraulic fluid tube is connected to the second right pump port. The hydraulic pump discharges hydraulic fluid, which flows in from the first left pump port, from the second left pump port and discharges hydraulic fluid, which flows in from the second left pump port, from the first left pump port. The hydraulic pump discharges hydraulic fluid, which flows in from the first right pump port, from the second right pump port and discharges hydraulic fluid, which flows in from the second right pump port, from the first right pump port.

A bulldozer according to a fifth aspect of the present invention is the bulldozer according to the fourth aspect where the first left hydraulic fluid tube and the second left hydraulic fluid tube are disposed so as not to intersect with the first right hydraulic fluid tube and the second right hydraulic fluid tube in a plan view.

A bulldozer according to a sixth aspect of the present invention is the bulldozer according to any of the first to the fifth aspects where the vehicle frame body has a left cover member and a right cover member. The left cover member is disposed behind the left conduit hole. The left cover member covers a portion of the first left hydraulic fluid tube and a portion of the second left hydraulic fluid tube. The right cover member is disposed behind the right conduit hole and the right cover member covers a portion of the first right hydraulic fluid tube and a portion of the second right hydraulic fluid tube. The left cover member and the right cover member are disposed to be separated from each other in the left and right direction. An opening, which is positioned between the left cover member and the right cover member, is provided in the vehicle body frame.

A bulldozer according to a seventh aspect of the present invention is the bulldozer according to any of the first to the sixth aspects where the cross member is a casting which is integrally formed.

In the bulldozer according to the first aspect of the present invention, the first and second left hydraulic fluid tubes are disposed so as to pass through the left conduit hole. In addition, the first and second right hydraulic fluid tubes are disposed so as to pass through the right conduit hole. As a result, it is possible for the curvature of each of the hydraulic fluid tubes to be reduced compared to a case where the hydraulic fluid tubes are disposed to bridge over the cross member. Due to this, it is possible to improve fuel efficiency.

As in the bulldozer according to the second aspect, in a case where the left and right hydraulic motors are disposed at positions which are lower than the hydraulic pump, the curvature of each of the hydraulic fluid tubes is increased even more when the hydraulic fluid tubes are disposed to bridge over the cross member. However, in the bulldozer of the present aspect, it is possible to improve fuel efficiency since it is possible for the curvature of each of the hydraulic fluid tubes to be reduced.

In the bulldozer according to the third aspect of the present invention, it is possible for the curvature of each of the hydraulic fluid tubes to be further reduced since it is possible for the hydraulic fluid tubes to be disposed at low positions.

In the bulldozer according to the fourth aspect of the present invention, the first left hydraulic fluid tube and the second left hydraulic fluid tube which are connected to the left hydraulic motor are both connected to the left side surface of the hydraulic pump. Accordingly, the first left hydraulic fluid tube and the second left hydraulic fluid tube are both disposed so as to extend backward from the left side surface of the hydraulic pump, pass through the left conduit hole, and reach the left hydraulic motor. In addition, the first right hydraulic fluid tube and the second right hydraulic fluid tube which are connected to the right hydraulic motor are both connected to the right side surface of the hydraulic pump. Accordingly, the first right hydraulic fluid tube and the second right hydraulic fluid tube are both disposed to extend backward from the right side surface of the hydraulic pump, pass through the right conduit hole, and reach the right hydraulic motor. As a result, it is possible for the curvature of each of the hydraulic fluid tubes to be reduced and it is possible for the length of each of the hydraulic fluid tubes to be shortened.

In the bulldozer according to the fifth aspect of the present invention, it is possible for the curvature of each of the hydraulic fluid tubes to be reduced and it is possible for the length of each of the hydraulic fluid tubes to be shortened.

In the bulldozer according to the sixth aspect of the present invention, the opening, which is positioned between the left cover member and the right cover member, is provided in the vehicle body frame. As a result, it is possible to easily perform inspection of the inner portion of the vehicle body frame through the opening.

In the bulldozer according to the seventh aspect of the present invention, manufacturing of the cross member is easy. In addition, it is possible to suppress a reduction in the strength of the cross member even if the left conduit hole and the right conduit hole are provided in the cross member.

DETAILED DESCRIPTION OF THE EMBODIMENTS

Figure 1:
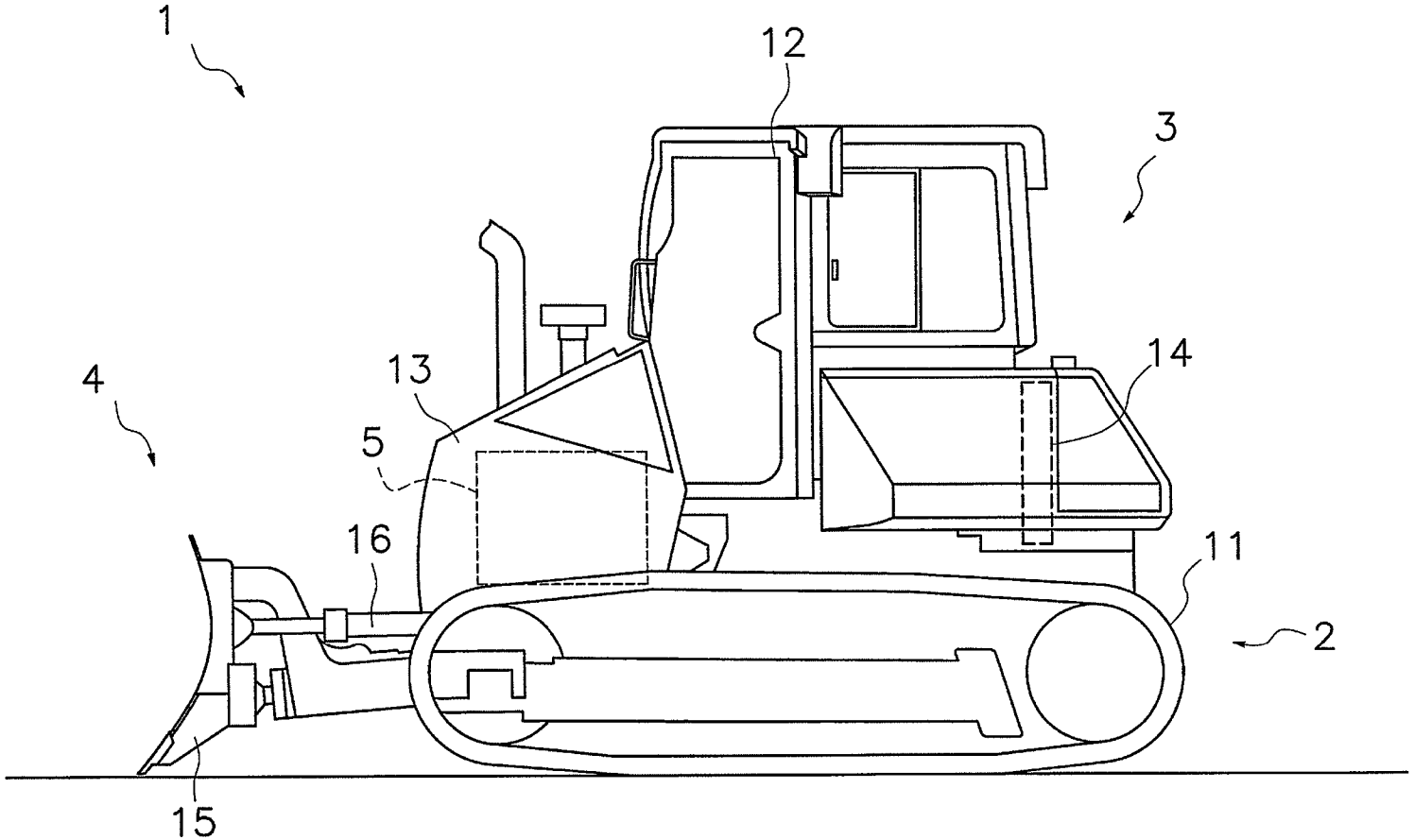
FIG. 1 is a side view of a bulldozer according to an embodiment of the present invention.

A side view of a bulldozer 1 according to an embodiment of the present invention is shown in FIG. 1. The bulldozer 1 is provided with left and right traveling devices 2, a vehicle body 3, and a work implement 4. The traveling devices 2 are devices for moving the vehicle and have crawler tracks 11. The bulldozer 1 is moved by the driving of the crawler tracks 11. Here, only the traveling device 2 on the left side out of the left and right traveling devices is shown in FIG. 1. Here, in the description below, front and back have the meaning of the front and back of the bulldozer 1. In addition, left and right have the meaning of the respective directions of left and right in a state of viewing forward from inside of a cab 12 of the bulldozer 1.

The vehicle body 3 includes a vehicle body frame 10 (refer to FIGS. 2 to 5), the cab 12, an engine cover 13, and a cooling device 14. The cab 12 is supported by the vehicle body frame 10. The engine cover 13 is disposed in front of the cab 12. The engine 5 is accommodated in the engine cover 13. The upper surface of the engine cover 13 is inclined downwards with a forward inclination. The cooling device 14 is disposed behind the cab 12. The cooling device 14 includes, for example, a radiator which cools coolant of the engine 5 and an oil cooler which cools the hydraulic fluid.

The work implement 4 is disposed in front of the engine cover 13. The work implement 4 has a blade 15 and hydraulic cylinders 16. The blade 15 is provided to be able to swing in the up and down direction. The hydraulic cylinders 16 change the posture of the blade 15.

Figure 2:
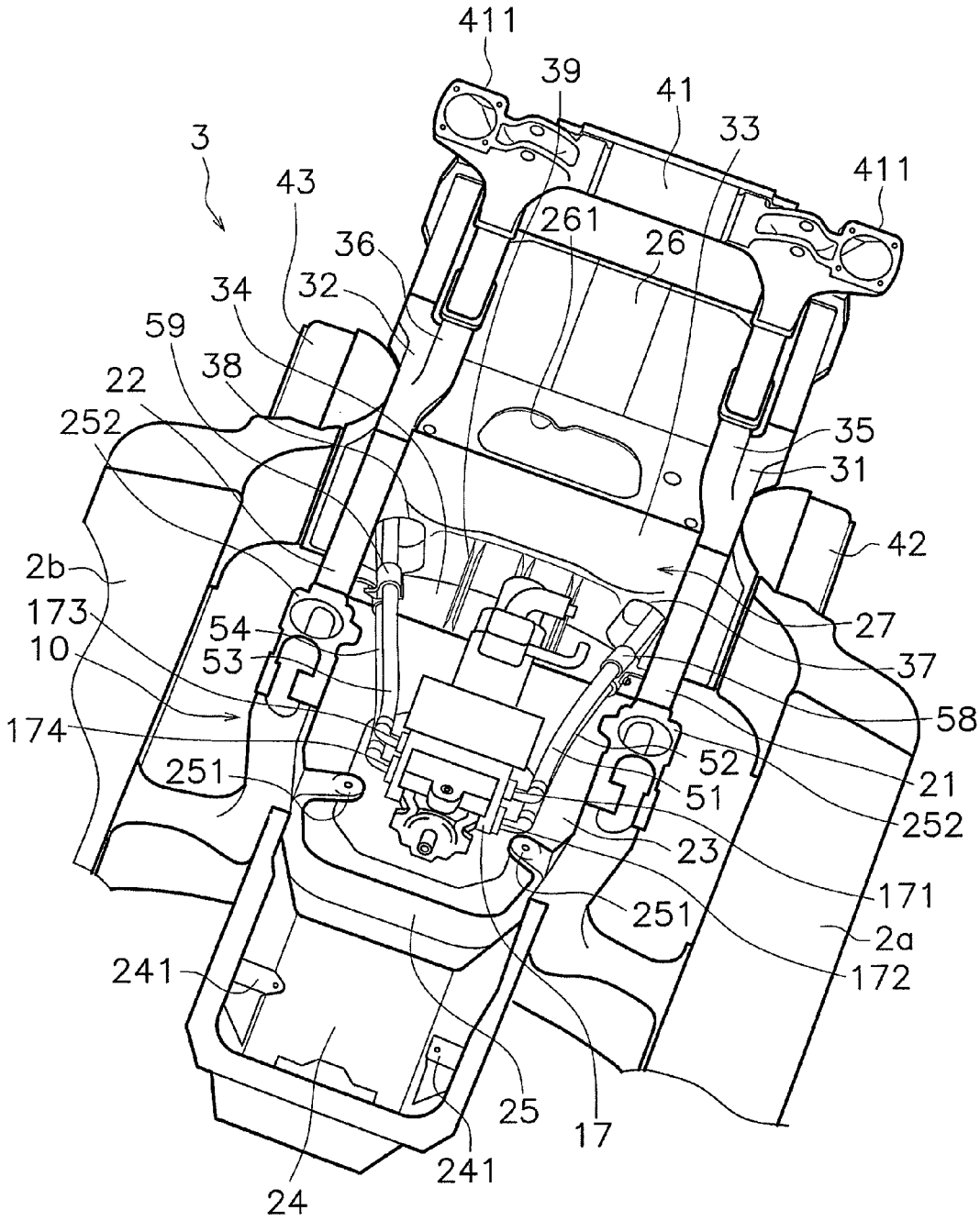
FIG. 2 is a perspective view illustrating an inner configuration of a bulldozer.
Figure 3:
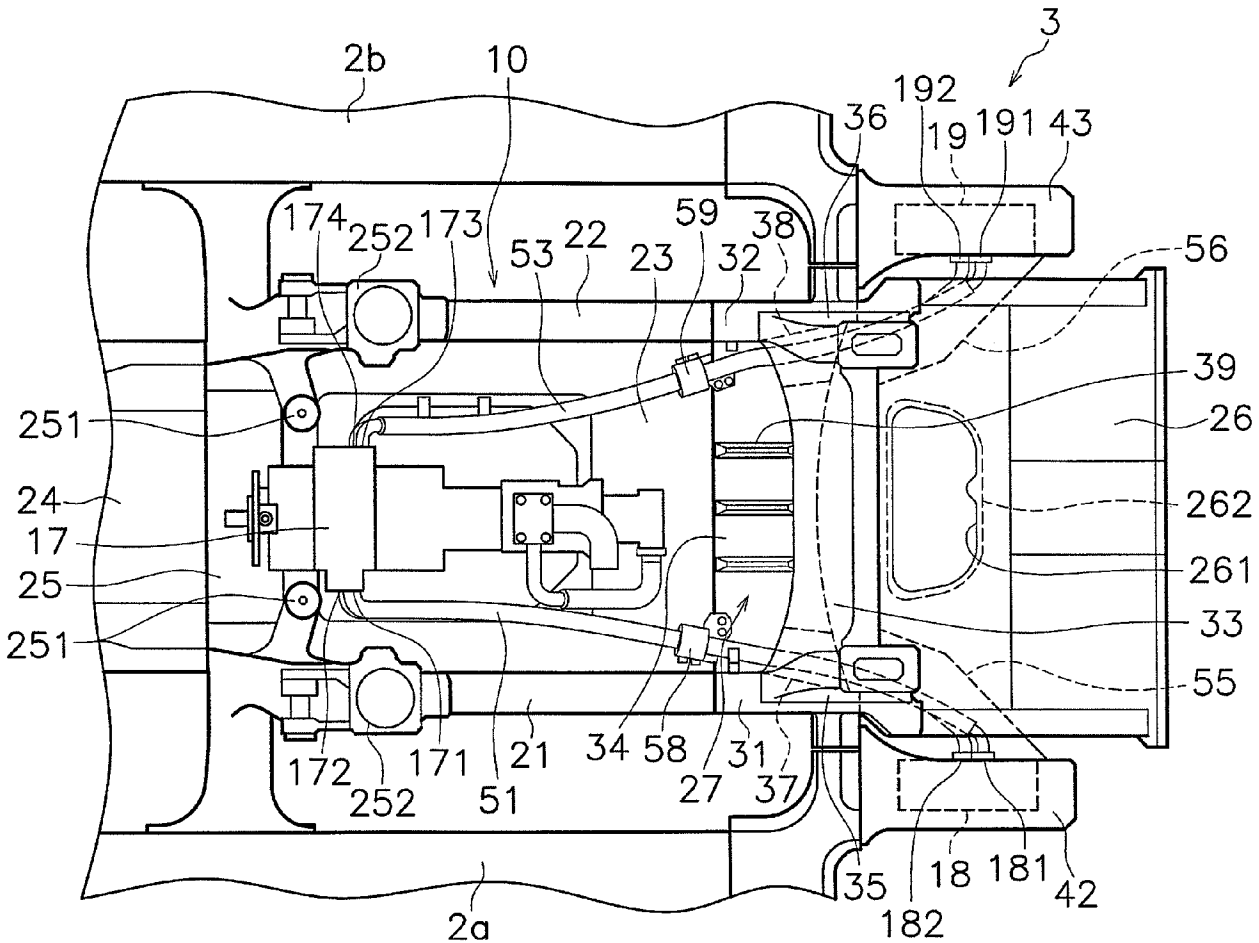
FIG. 3 is a top view illustrating an inner configuration of the bulldozer.
Figure 4:
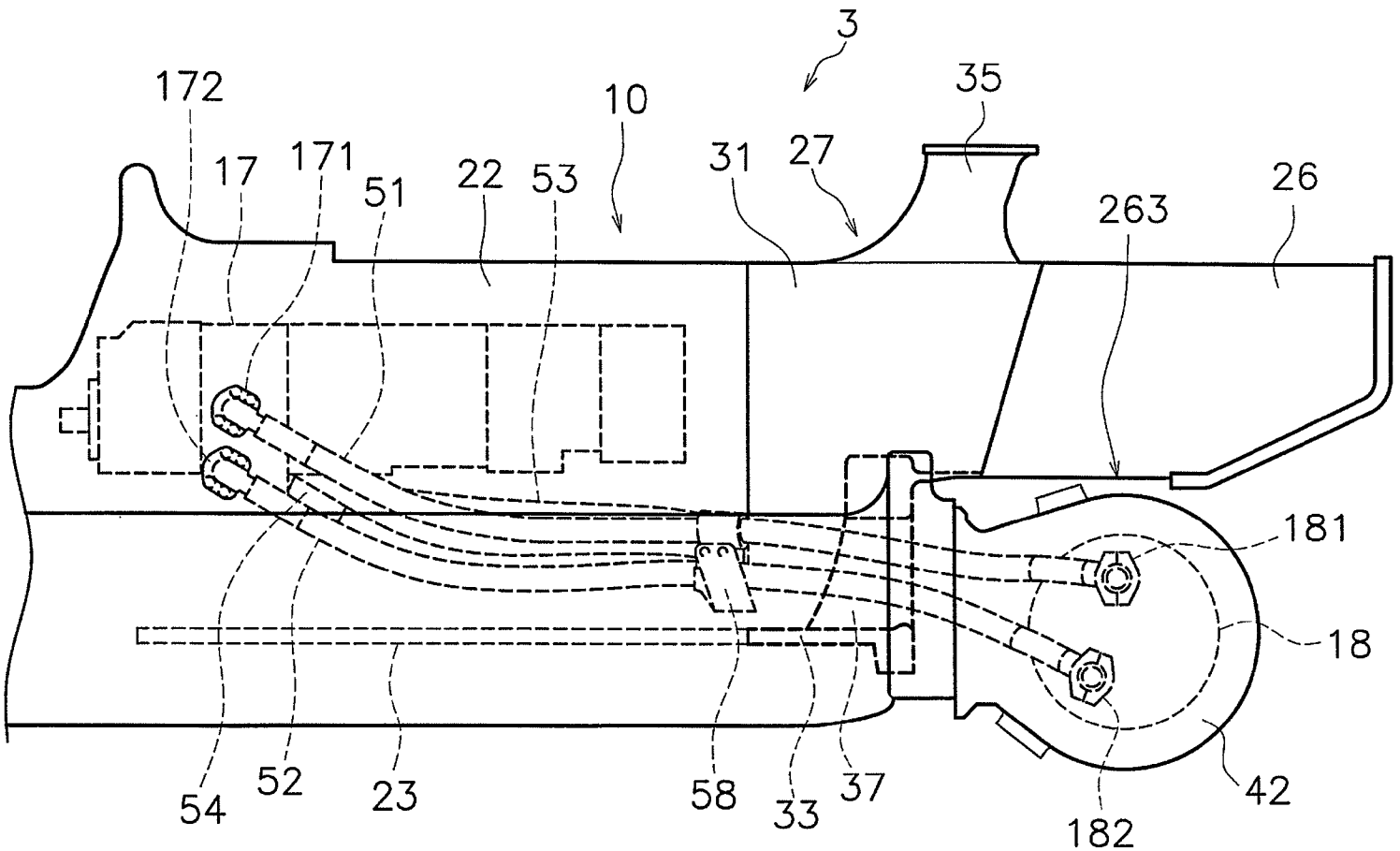
FIG. 4 is a side view illustrating an inner configuration of the bulldozer.
Figure 5:
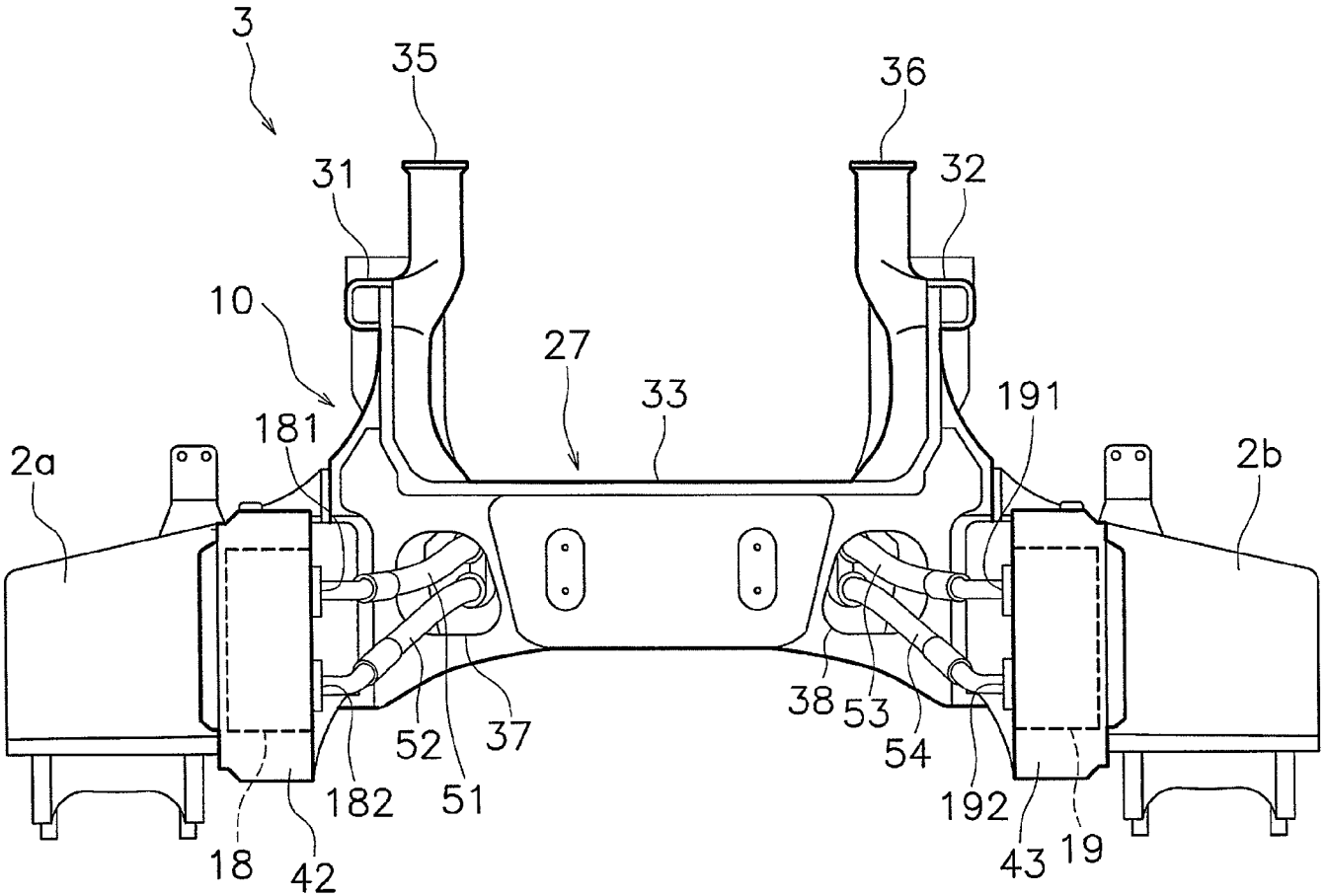
FIG. 5 is a rear view illustrating an inner configuration of the bulldozer.

FIG. 2 is a perspective view illustrating an inner configuration of the vehicle body 3. FIG. 3 is a top view illustrating an inner configuration of the vehicle body 3. FIG. 4 is a side view illustrating an inner configuration of the vehicle body 3. FIG. 5 is a rear view illustrating an inner configuration of the vehicle body 3. Here, diagrammatic representation of the engine 5 is omitted in FIGS. 2 to 5.

The vehicle body frame 10 has a left side frame 21, a right side frame 22, a base plate 23, a front frame 24, a front cross member 25, a rear frame 26, and a rear cross member 27. Here, diagrammatic representation of a portion of the vehicle body frame 10 which includes the rear frame 26 is omitted in FIG. 5.

The left and right side frames 21 and 22 are each disposed so as to extend in the front and rear direction. The left and right side frames 21 and 22 are disposed to line up in the left and right direction. A frame section 2*a* of the traveling device 2 which is on the left side described above (referred to below as a "left traveling frame 2*a*") is disposed to the left of the left side frame 21. A frame section 2*b* of the traveling device 2 which is on the right side (referred to below as a "right traveling frame 2*b*") is disposed to the right of the right side frame 22. The base plate 23 is disposed to span across between the left and right side frames 21 and 22.

The front frame 24 is disposed in front of the left and right side frames 21 and 22. The front frame 24 supports the engine cover 13. As shown in FIG. 2, the front frame 24 has a front engine mounting section 241. The front engine mounting section 241 supports the engine via a mounting device which is not shown in the diagram.

The front cross member 25 is disposed between the front frame 24 and the left and right side frames 21 and 22 in the front and back direction. The front cross member 25 is disposed so as to protrude leftward from the left side frame 21. The left traveling frame 2*a* is attached to a left side portion of the front cross member 25. The front cross member 25 is disposed so as to protrude rightward from the right side frame 22. The right traveling frame 2*b* is attached to a right side portion of the front cross member 25. The front cross member 25 has a rear engine mounting section 251. The rear engine mounting section 251 supports the engine 5 via a mounting device which is not shown in the diagram. The front cross member 25 has a front cab mounting section 252. The front cab mounting section 252 supports the cab 12 via a mounting device which is not shown in the diagram.

The rear frame 26 is disposed behind the left and right side frames 21 and 22. The rear frame 26 supports the cooling device 14. An opening 261 is provided in the rear frame 26. The opening 261 penetrates through the rear frame 26 in the up and down direction. An inspection cover 262 is attached in the opening 261 as shown in FIG. 3. As shown in FIG. 4, a base surface 263 of the rear frame 26 is positioned above base surfaces of the left and right side frames 21 and 22. That is, the base surface 263 of the rear frame 26 is positioned above the base plate 23.

The rear cross member 27 is disposed to span across between the left and right side frames 21 and 22. The rear cross member 27 is disposed between the left and right side frames 21 and 22 and the rear frame 26 in the front and back direction. The rear cross member 27 is a casting which is integrally formed. The rear cross member 27 has a left side wall section 31, a right side wall section 32, a main cross section 33, a base plate section 34, a left support section 35, and a right support section 36.

The left side wall section 31 and the right side wall section 32 are disposed to line up in the left and right direction. The left side wall section 31 is attached to the left side frame 21. The right side wall section 32 is attached to the right side frame 22. The left traveling frame 2*a* is attached to a left side surface of the left side wall section 31. The right traveling frame 2*b* is attached to a right side surface of the right side wall section 32.

The main cross section 33 is disposed to span across between the left side wall section 31 and the right side wall section 32. The base plate section 34 is disposed in front of the main cross section 33. The main cross section 33 is disposed to protrude upward from the base plate section 34. The base plate section 34 is disposed substantively in plane with the base plate 23. Accordingly, the main cross section 33 is disposed so as to protrude upward from the base plate 23.

The main cross section 33 has a left conduit hole 37 and a right conduit hole 38. The left conduit hole 37 and the right conduit hole 38 are disposed to be separated to the left and right. The left and right conduit holes 37 and 38 penetrate through the main cross section 33 in the front and back direction. More specifically, the left conduit hole 37 penetrates through the main cross section 33 leftward with a backward inclination. The right conduit hole 38 penetrates through the main cross section 33 rightward with a backward inclination. Base portions of the left and right conduit holes 37 and 38 are linked to the base plate section 34. Accordingly, the base portions of the left and right conduit holes 37 and 38 are positioned at the same height as the base plate 23. The left and right conduit holes 37 and 38 are positioned below the base surface 263 of the rear frame 26. As shown in FIG. 2 and FIG. 3, a rib 39 is provided to span across a front surface of the main cross section 33 and the base plate section 34. The rib 39 is positioned between the left and right conduit holes 37 and 38.

The left support section 35 protrudes upwards from the left side wall section 31. The right support section 36 protrudes upward from the right side wall section 32. As shown in FIG. 2, a cab mounting bracket 41 is attached to the left and right support sections 35 and 36. The cab mounting bracket 41 has a rear cab mounting section 411. The rear cab mounting section 411 supports the cab 12 via a mounting device which is not shown in the diagram. Here, the diagrammatic representation of the cab mounting bracket 41 is omitted in FIG. 3 to FIG. 5.

A left motor bracket 42 is attached to a rear portion of the left traveling frame 2*a*. A right motor bracket 43 is attached to a rear portion of the right traveling frame 2*b*. The left and right motor brackets 42 and 43 are positioned below the rear frame 26. The left and right motor brackets 42 and 43 are positioned behind the rear cross member 27. The left motor bracket 42 is positioned to the left of the left side wall section 31 of the rear cross member 27. The right motor bracket 43 is positioned to the right of the right side wall section 32 of the rear cross member 27.

As shown in FIG. 3, the bulldozer 1 is provided with a hydraulic pump 17, a left hydraulic motor 18, and a right hydraulic motor 19. The hydraulic pump 17 is driven by the engine 5. The hydraulic pump 17 is disposed behind the engine 5. The hydraulic pump 17 is disposed above the base plate 23. The hydraulic pump 17 is disposed in front of the rear cross member 27.

The hydraulic pump 17 has a first left pump port 171, a second left pump port 172, a first right pump port 173, and a second right pump port 174. The first left pump port 171 and the second left pump port 172 are provided on a left side surface of the hydraulic pump 17. Hydraulic fluid flows into the second left pump port 172 when hydraulic fluid flows out from the first left pump port 171. Hydraulic fluid flows into the first left pump port 171 when hydraulic fluid flows out from the second left pump port 172. As shown in FIG. 4, the second left pump port 172 is positioned below the first left port pump 171.

The first right pump port 173 and the second right pump port 174 are provided in a right side surface of the hydraulic pump 17. Hydraulic fluid flows into the second right pump port 174 when hydraulic fluid flows out from the first right pump port 173. Hydraulic fluid flows into the first right pump port 173 when hydraulic fluid flows out from the second right pump port 174. The second right pump port 174 is positioned below the first right pump port 173.

The left hydraulic motor 18 and the right hydraulic motor 19 are driven using the hydraulic fluid which is discharged from the hydraulic pump 17. The crawler tracks 11 of the traveling device 2 which is on the left side are driven by the driving of the left hydraulic motor 18. The crawler tracks 11 of the traveling device 2, which are on the right side, are driven by the driving of the right hydraulic motor 19. Accordingly, the bulldozer 1 travels by the driving of the left and right hydraulic motors 18 and 19.

The left and right hydraulic motors 18 and 19 are disposed behind the hydraulic pump 17. The left and right hydraulic motors 18 and 19 are disposed at positions which are lower than the hydraulic pump 17. The left hydraulic motor 18 is disposed in the left motor bracket 42. The right hydraulic motor 19 is disposed in the right motor bracket 43. Accordingly, the left and right hydraulic motors 18 and 19 are positioned below the rear frame 26. The left and right hydraulic motors 18 and 19 are positioned behind the rear cross member 27. In other words, the rear cross member 27 is positioned between the hydraulic pump 17 and the left and right hydraulic motors 18 and 19 in the front and back direction. The left hydraulic motor 18 is positioned to the left of the left side wall section 31 of the rear cross member 27. The right hydraulic motor 19 is positioned to the right of the right side wall section 32 of the rear cross member 27.

The left hydraulic motor 18 has a first left motor port 181 and a second left motor port 182. The first left motor port 181 and the second left motor port 182 are provided at a right side surface of the left hydraulic motor 18. The left hydraulic motor 18 discharges the hydraulic fluid, which flows in from the first left motor port 181, from the second left motor port 182. The left hydraulic motor 18 discharges the hydraulic fluid, which flows in from the second left motor port 182, from the first left motor port 181. As shown in FIG. 4, the second left motor port 182 is positioned below the first left motor port 181.

The right hydraulic motor 19 has a first right motor port 191 and a second right motor port 192. The first right motor port 191 and the second right motor port 192 are provided at a left side surface of the right hydraulic motor 19. The right hydraulic motor 19 discharges the hydraulic fluid, which flows in from the first right motor port 191, from the second right motor port 192. The right hydraulic motor 19 discharges the hydraulic fluid, which flows in from the second right motor port 192, from the first right motor port 191. The second right motor port 192 is positioned below the first right motor port 191.

The hydraulic pump 17 and the left hydraulic motor 18 are connected by a first left hydraulic fluid tube 51 and a second left hydraulic fluid tube. The first left hydraulic fluid tube 51 connects the first left pump port 171 and the first left motor port 181. The second left hydraulic fluid tube 52 connects the second left pump port 172 and the second left motor port 182. The first left hydraulic fluid tube 51 and the second left hydraulic fluid tube 52 are disposed so as to pass through the left conduit hole 37. Accordingly, the first left hydraulic fluid tube 51 is disposed to extend backward from the first left pump port 171, pass through the left conduit hole 37, and reach the first left motor port 181. The second left hydraulic fluid tube 52 is disposed to extend backward from the second left pump port 172, pass through the left conduit hole 37, and reach the second left motor port 182. The first left hydraulic fluid tube 51 and the second left hydraulic fluid tube 52 are bunched together using a left tube bracket 58 and are attached to the base plate section 34 of the rear cross member 27.

The hydraulic pump 17 and the right hydraulic motor 19 are connected by a first right hydraulic fluid tube 53 and a second right hydraulic fluid tube 54. The first right hydraulic fluid tube 53 connects the first right pump port 173 and the first right motor port 191. The second right hydraulic fluid tube 54 connects the second right pump port 174 and the second right motor port 192. The first right hydraulic fluid tube 53 and the second right hydraulic fluid tube 54 are disposed so as to pass through the right conduit hole 38. Accordingly, the first right hydraulic fluid tube 53 is disposed to extend backward from the first right pump port 173, pass through the right conduit hole 38, and reach the first right motor port 192. The second right hydraulic fluid tube 54 is disposed to extend backward from the second right pump port 174, pass through the right conduit hole 38, and reach the second right motor port 192. The first right hydraulic fluid tube 53 and the second right hydraulic fluid tube 54 are bunched together using a right piping bracket 59 and are attached to the base plate section 34 of the rear cross member 27.

Here, a left cover member 55 is attached to the first left motor bracket 42. The left cover member 55 is disposed behind the left conduit hole 37. The left cover member 55 has a shape which is curved toward the rear with a leftward inclination in a plan view. The left cover member 55 covers the first left motor port 181 and the second left motor port 182, a portion of the first left hydraulic fluid tube 51, and a portion of the second left hydraulic fluid tube 52.

A right cover member 56 is attached to the first right motor bracket 43. The right cover member 56 is disposed behind the right conduit hole 38. The right cover member 56 has a shape which is curved toward the rear with a rightward inclination in a plan view. The right cover member 56 covers the first right motor port 191 and the second right motor port 192, a portion of the first right hydraulic fluid tube 53, and a portion of the second right hydraulic fluid tube 54. The opening 261 in the rear frame 26 described above is positioned between the left cover member 55 and the right cover member 56 in the plan view.

The first left hydraulic fluid tube 51 and the second left hydraulic fluid tube 52 are disposed so as not to intersect with the first right hydraulic fluid tube 53 and the second right hydraulic fluid tube 54 in a plan view. That is, the first left hydraulic fluid tube 51 is disposed so as not to intersect with the first right hydraulic fluid tube 53 and the second right hydraulic fluid tube 54 in a plan view. In addition, the second left hydraulic fluid tube 52 is disposed so as not to intersect with the first right hydraulic fluid tube 53 and the second right hydraulic fluid tube 54 in a plan view.

The second left hydraulic fluid tube 52 is disposed below the first left hydraulic fluid tube 51. The first left hydraulic fluid tube 51 and the second left hydraulic fluid tube 52 are disposed so as not to intersect with each other in a side view. The second right hydraulic fluid tube 54 is disposed below the first right hydraulic fluid tube 53. The first right hydraulic fluid tube 53 and the second right hydraulic fluid tube 54 are disposed so as not to intersect with each other in a side view.

Figure 6:
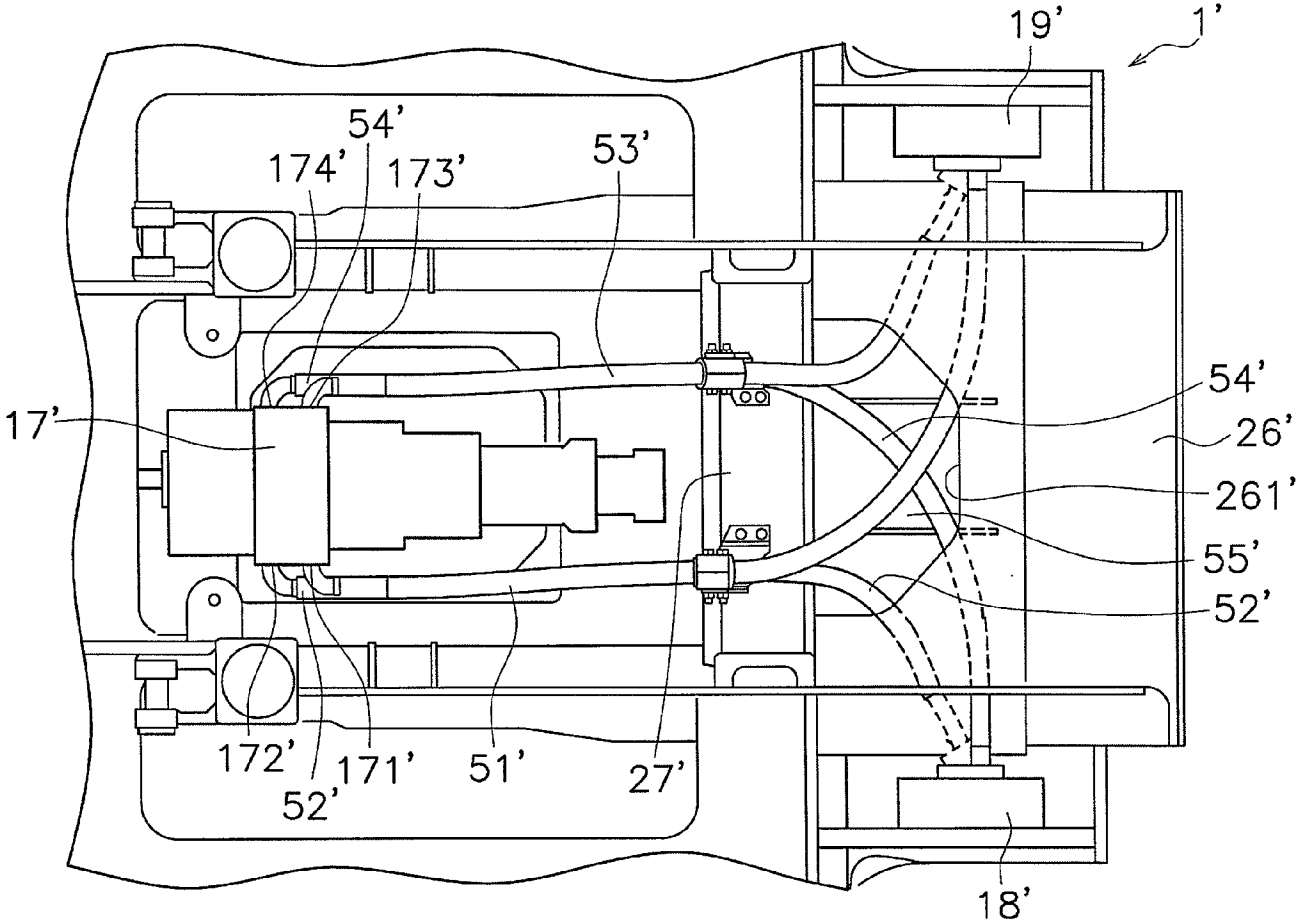
FIG. 6 is a top view illustrating an inner configuration of the bulldozer according to a technique which is related to the present invention.
Figure 7:
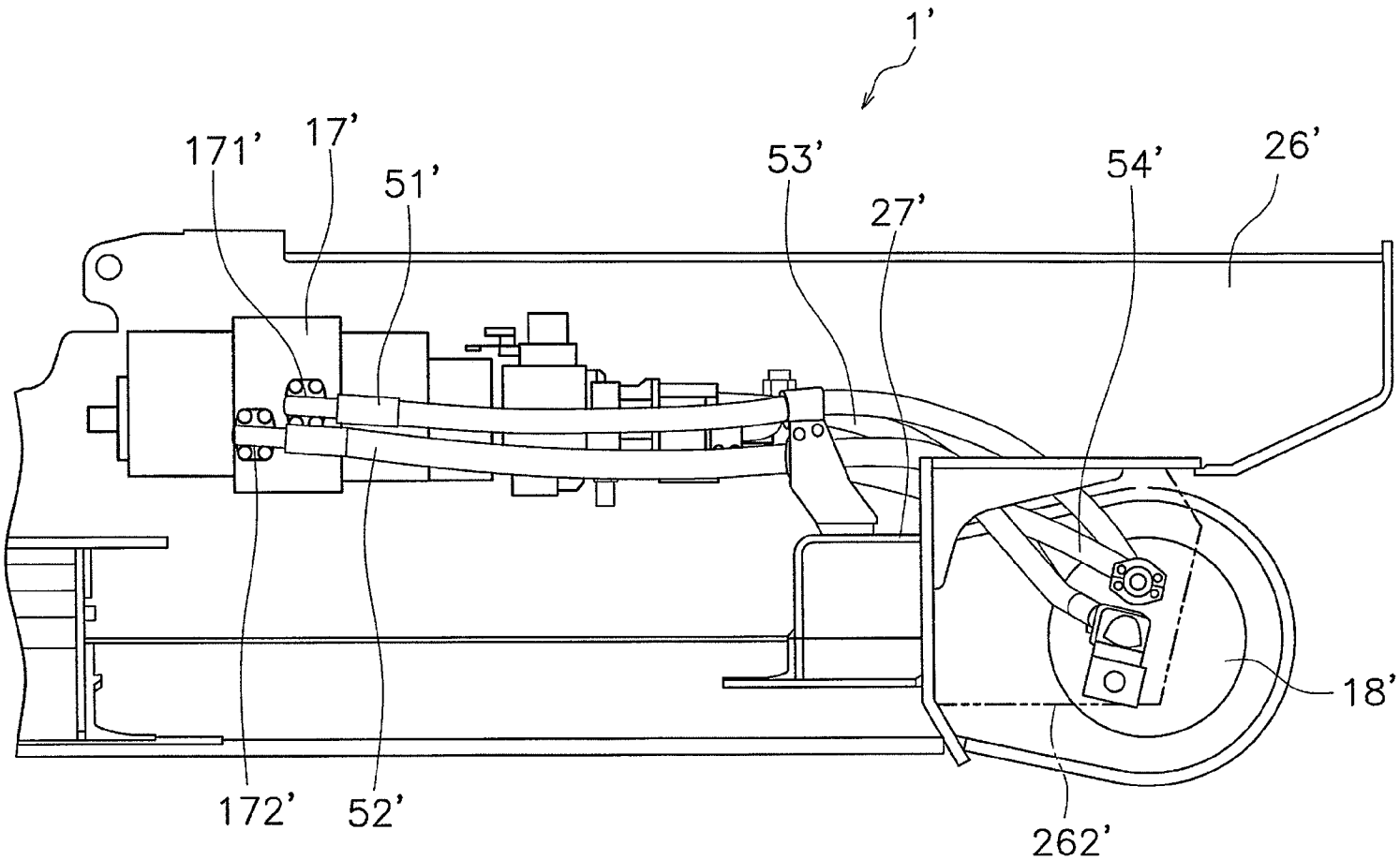
FIG. 7 is a side view illustrating an inner configuration of the bulldozer according to the related technique.

FIG. 6 is a top view illustrating an inner configuration of a bulldozer 1' according to a technique which is related to the bulldozer 1 according to the present embodiment. FIG. 7 is a side view illustrating an inner configuration of the bulldozer 1' according to the related technique. In the bulldozer 1' according to the related technique, a hydraulic pump 17' discharges hydraulic fluid, which flows in from a first left pump port 171', from a first right pump port 173'. The hydraulic pump 17' discharges hydraulic fluid, which flows in from the first right pump port 173', from the first left pump port 171'.

As a result, a first left hydraulic fluid tube 51' extends backward from the first left pump port 171', passes above a rear cross member 27', and is connected to a right hydraulic motor 19'. In addition, a first right hydraulic fluid tube 53' extends backward from the first right pump port 173', passes above the rear cross member 27', and is connected to the right hydraulic motor 19'. As a result, the first left hydraulic fluid tube 51' is curved to the right and downwards behind the rear cross member 27'. The first right hydraulic fluid tube 53' is curved to the right and downwards behind the rear cross member 27'.

In addition, in the bulldozer 1' according to the related technique, the hydraulic pump 17' discharges hydraulic fluid, which flows in from a second left pump port 172', from a second right pump port 174'. The hydraulic pump 17' discharges hydraulic fluid, which flows in from the second right pump port 174', from the second left pump port 172'.

As a result, a second left hydraulic fluid tube 52' extends backward from the second left pump port 172', passes above the rear cross member 27', and is connected to a left hydraulic motor 18'. In addition, a second right hydraulic fluid tube 54' extends backward from the second right pump port 174', passes above the rear cross member 27', and is connected to the left hydraulic motor 18'. As a result, the second left hydraulic fluid tube 52' is curved to the left and downwards behind the rear cross member 27'. The second right hydraulic fluid tube 54' is curved to the left and downwards behind the rear cross member 27'.

In addition, the first left hydraulic fluid tube 51' and the second right hydraulic fluid tube 54' intersect in a plan view. The first left hydraulic fluid tube 51', the first right hydraulic fluid tube 53', the second left hydraulic fluid tube 52', and the second right hydraulic fluid tube 54' are introduced below a rear frame 26' through an opening 261'. A cover member 55' is attached to a lower surface of the rear frame 26'. The cover member 55' covers a portion of the first left hydraulic fluid tube 51', the first right hydraulic fluid tube 53', the second left hydraulic fluid tube 52', and the second right hydraulic fluid tube 54' below the rear frame 26'.

In the bulldozer 1 according to the present embodiment, the first left hydraulic fluid tube 51 and the second left hydraulic fluid tube 52 are disposed so as to pass through the left conduit hole 37. In addition, the first right hydraulic fluid tube 53 and the second right hydraulic fluid tube 54 are disposed so as to pass through the right conduit hole 38. As a result, it is possible for the curvature of each of the hydraulic fluid tubes 51 to 54 to be reduced compared to a case where the left and right hydraulic fluid tubes 51' to 54' are disposed so as to bridge over the rear cross member 27' as with the bulldozer 1' according to the related technique. Due to this, it is possible to improve fuel efficiency.

In particular, as shown in FIG. 7, the curvature of each of the hydraulic fluid tubes 51' to 54' is further increased when the left and right hydraulic fluid tubes 51' to 54' are disposed so as to bridge over the rear cross member 27' in a case where the left and right hydraulic motors 18' and 19' are disposed at positions which are lower than the hydraulic pump 17'. However, as shown in FIG. 3, in the bulldozer 1 according to the present embodiment, it is possible to improve fuel efficiency since it is possible for the curvature of each of the hydraulic fluid tubes 51 to 54 to be reduced.

In the bulldozer 1 according to the present embodiment, the base portions of the left and right conduit holes 37 and 38 are positioned at the same height as the base plate 23. As a result, it is possible for the curvature of each of the hydraulic fluid tubes 51 to 54 to be further reduced since it is possible to position the hydraulic fluid tubes 51 to 54 at low positions.

In the bulldozer 1 according to the present embodiment, the first left hydraulic fluid tube 51 and the second left hydraulic fluid tube 52 which are connected to the left hydraulic motor 18 are both connected to the left side surface of the hydraulic pump 17. Accordingly, the first left hydraulic fluid tube 51 and the second hydraulic left fluid tube 52 are both disposed to extend backward from the left side surface of the hydraulic pump 17, pass through the left conduit hole 37, and reach the left hydraulic motor 18. In addition, the first right hydraulic fluid tube 53 and the second right hydraulic fluid tube 54 which are connected to the right hydraulic motor 19 are both connected to the right side surface of the hydraulic pump 17. Accordingly, the first right hydraulic fluid tube 53 and the second right hydraulic fluid tube 54 are both disposed to extend backward from the right side surface of the hydraulic pump 17, pass through the right conduit hole 38, and reach the right hydraulic motor 19. As a result, it is possible for the curvature of each of the hydraulic fluid tubes 51 to 54 to be reduced and it is possible for the length of each of the hydraulic fluid tubes 51 to 54 to be shortened.

In the bulldozer 1 according to the present embodiment, the first left hydraulic fluid tube 51 and the second left hydraulic fluid tube 52 are disposed so as not to intersect with the first right hydraulic fluid tube 53 and the second right hydraulic fluid tube 54 in a plan view. As a result, it is possible for the curvature of each of the hydraulic fluid tubes 51 to 54 to be reduced and it is possible for the length of each of the hydraulic fluid tubes 51 to 54 to be shortened.

In the bulldozer 1 according to the present embodiment, the opening 261, which is positioned between the left cover member 55 and the right cover member 56, is provided in the vehicle body frame 10. As a result, it is possible to easily perform inspection of the inner portion of the vehicle body frame 10 through the opening 261.

In the bulldozer 1 according to the present embodiment, the rear cross member 27 is a casting which is integrally formed. Accordingly, manufacturing of the rear cross member 27 is easy. In addition, it is possible to suppress a reduction in the strength of the rear cross member 27 even if the left conduit hole 37 and the right conduit hole 38 are provided in the rear cross member 27.

Above, an embodiment of the present invention has been described but the present invention is not limited to the embodiment described above and various modifications are possible within the scope which does not depart from the gist of the invention. For example, the shape of the body frame is not limited to the shape described above and there may be modifications. The shape of the rear cross member is not limited to the shape described above and there may be modifications. The base portions of the left and right conduit holes may be disposed above the base plate. The rear cross member may be configured by combining a plurality of separate parts.

According to the present invention, it is possible to provide a bulldozer where it is possible to improve fuel efficiency.

The invention claimed is:

1. A bulldozer comprising:

a vehicle frame body;

an engine supported by the vehicle body frame;

a hydraulic pump driven by the engine;

a left hydraulic motor and a right hydraulic motor for movement, the left and right hydraulic motors being disposed behind the hydraulic pump, the left and right hydraulic motors being driven using hydraulic fluid discharged from the hydraulic pump;

a first left hydraulic fluid tube and a second left hydraulic fluid tube, the first and second left hydraulic fluid tubes connecting the hydraulic pump and the left hydraulic motor; and a first right hydraulic fluid tube and a second right hydraulic fluid tube, the first and second right hydraulic fluid tubes connecting the hydraulic pump and the right hydraulic motor, the vehicle body frame including a left side frame and a right side frame, the left and right side frames extending in the front and back direction, the vehicle body frame further including a base plate disposed to span across between the left and right side frames, and a cross member positioned between the hydraulic pump and the left and right hydraulic motors in a front and back direction of the bulldozer, the cross member being disposed so as to protrude upward from the base plate, the cross member being disposed to span across between the left and right side frames, the cross member including a left conduit hole and a right conduit hole, the left and right conduit holes being spaced apart in a left and right direction of the bulldozer, the first and second left hydraulic fluid tubes passing through the left conduit hole, and the first and second right hydraulic fluid tubes passing through the right conduit hole.

2. The bulldozer according to claim 1, wherein the left hydraulic motor and the right hydraulic motor are disposed in positions which are lower than the hydraulic pump.

3. The bulldozer according to claim 2, wherein a base portion of the left conduit hole and a base portion of the right conduit hole are positioned at the same height as the base plate.

4. The bulldozer according to claim 3, wherein the cross member is a casting which is integrally formed.

5. The bulldozer according to claim 2, wherein the cross member is a casting which is integrally formed.

6. The bulldozer according to claim 1, wherein the hydraulic pump has a first left pump port, a second left pump port, a first right pump port and a second right pump port, the first and second left pump ports being provided on a left side surface of the hydraulic pump, the first and second right pump ports being provided on a right side surface of the hydraulic pump, the first left hydraulic fluid tube is connected to the first left pump port, the second left hydraulic fluid tube is connected to the second left pump port, the first right hydraulic fluid tube is connected to the first right pump port, the second right hydraulic fluid tube is connected to the second right pump port, the hydraulic pump discharges hydraulic fluid, which flows in from the first left pump port, from the second left pump port and discharges hydraulic fluid, which flows in from the second left pump port, from the first left pump port, and the hydraulic pump discharges hydraulic fluid, which flows in from the first right pump port, from the second right pump port and discharges hydraulic fluid, which flows in from the second right pump port, from the first right pump port.

7. The bulldozer according to claim 6, wherein the first left hydraulic fluid tube and the second left hydraulic fluid tube are disposed so as not to intersect with the first right hydraulic fluid tube and the second right hydraulic fluid tube in a plan view.

8. The bulldozer according to claim 7, wherein the cross member is a casting which is integrally formed.

9. The bulldozer according to claim 6, wherein the cross member is a casting which is integrally formed.

10. The bulldozer according to claim 1, wherein the vehicle frame body has a left cover member disposed behind the left conduit hole and a right cover member disposed behind the right conduit hole, the left cover member covering a portion of the first left hydraulic fluid tube and a portion of the second left hydraulic fluid tube, the right cover member covering a portion of the first right hydraulic fluid tube and a portion of the second right hydraulic fluid tube, the left cover member and the right cover member are separated from each other in the left and right direction, and the vehicle body frame has an opening positioned between the left cover member and the right cover member.

11. The bulldozer according to claim 10, wherein the cross member is a casting which is integrally formed.

12. The bulldozer according to claim 1, wherein the cross member is a casting which is integrally formed.

* * * * *